US007775498B2

(12) United States Patent
Phillips et al.

(10) Patent No.: US 7,775,498 B2
(45) Date of Patent: Aug. 17, 2010

(54) ANTI-TIP DEVICE FOR AN APPLIANCE WITH AN INTERLOCK SWITCH

(75) Inventors: Bryan Thomas Phillips, Hendersonville, TN (US); David Shadwick, White House, TN (US); Howard Edgar Buckles, Burton, OH (US); Randall Lewis Fuller, Gallatin, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 152 days.

(21) Appl. No.: 11/768,473

(22) Filed: Jun. 26, 2007

(65) Prior Publication Data

US 2009/0001246 A1 Jan. 1, 2009

(51) Int. Cl.
*F16M 13/00* (2006.01)

(52) U.S. Cl. ..... 248/550; 248/500; 248/501

(58) Field of Classification Search ..... 248/680, 248/673, 677, 550, 500, 501
See application file for complete search history.

(56) References Cited

U.S. PATENT DOCUMENTS

| | | | |
|---|---|---|---|
| 4,277,659 | A | 7/1981 | DeRemer |
| 5,624,098 | A | 4/1997 | McDowell |
| 5,780,792 | A | 7/1998 | Fritts et al. |
| 6,533,238 | B2 | 3/2003 | Barnes et al. |
| 6,552,314 | B2 | 4/2003 | Fukushima et al. |
| 2007/0133157 | A1 | 6/2007 | Tsang |
| 2009/0051371 | A1 * | 2/2009 | Morimoto ..... 324/661 |

FOREIGN PATENT DOCUMENTS

| | | |
|---|---|---|
| EP | 1172061 | 12/2005 |

OTHER PUBLICATIONS

International Search Report for PCT/US2008/064044, dated Sep. 17, 2008, 2 pages.

* cited by examiner

*Primary Examiner*—Amy J Sterling
(74) *Attorney, Agent, or Firm*—Pearne & Gordon LLP

(57) ABSTRACT

An appliance includes a leg for support upon a support surface, an interlock switch mechanically coupled to the leg and electrically coupled to control circuitry of the appliance, an anti-tip bracket having an aperture configured to receive a portion of the leg, and means for operating the interlock switch when the leg is properly positioned within the aperture. In one example, an actuator is coupled to the leg and is movable relative to the leg when the leg is positioned within the aperture. In another example, the interlock switch includes a first and second electrode, and selective electrical contact occurs between the first and second electrodes when the actuator is moved. In another example, a member projects from the appliance and the anti-tip is configured to receive a portion of the member. A method is also provided for preventing use of an appliance due to improper installation of the appliance.

30 Claims, 8 Drawing Sheets

ANTI-TIP DEVICE FOR AN APPLIANCE WITH AN INTERLOCK SWITCH

RELATED APPLICATIONS

Not Applicable.

FIELD OF THE INVENTION

The present invention relates generally to an anti-tip device for an appliance, and more particularly, to an anti-tip device for an appliance having an interlock switch.

BACKGROUND OF THE INVENTION

Several types of appliances, such as ranges, dishwashers, refrigerators, freezers, etc., may be subjected to user-applied loads which can undesirably tip the appliance during use. For example, during use of a conventional range, it is often necessary to open an oven door of the appliance. In this condition, subjecting the door to a downward force beyond a certain threshold can result in tipping of the appliance. If, for example, a hot pan is on the top surface of the range, this could result in an undesirable condition. For obvious reasons, it is desirable to avoid the potential for such a tipping action.

A drawback of conventional anti-tip devices for appliances is that they may not be installed, or if installed, may not be installed properly or may not be properly engaged with the appliance. Further, the anti-tip device may be disconnected to clean, service, or relocate the appliance, and then may not be properly re-connected. Additionally, it may not be readily obvious to a user if the device is properly installed and engaged with the appliance when the appliance is in use.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, an appliance includes a leg for supporting the appliance upon a support surface, an actuator coupled to and movable relative to the leg, and an interlock switch electrically coupled to control circuitry of the appliance. The appliance also includes an anti-tip bracket having an aperture configured to receive a portion of the leg. The actuator is moved relative to the leg when the leg is positioned within the aperture, and the actuator is adapted to interact with the interlock switch when the leg is properly positioned within the aperture.

In accordance with another aspect of the present invention, a leveling leg for use with an appliance includes a main shaft and an actuator movable relative to the main shaft. The actuator is resiliently biased towards a first direction and is adapted to be movable towards a second direction via engagement with an anti-tip bracket. The leveling leg also includes an interlock switch adapted to be electrically coupled to control circuitry of an appliance and including a first electrode and a second electrode. The second electrode is coupled to a portion of the actuator such that selective electrical contact occurs between the first and second electrodes when the actuator is moved towards the second direction.

In accordance with another aspect of the present invention, a method is provided for preventing use of an appliance due to improper installation of the appliance. The method includes the steps of providing a leg for supporting the appliance upon a support surface where the leg includes an actuator movable relative to the leg, and providing an interlock switch electrically coupled to control circuitry of the appliance. The method also includes the step of providing an anti-tip bracket having an aperture configured to receive a portion of the leg to prevent tipping of the appliance. The actuator is adapted to move relative to the leg and interact with the interlock switch when the leg is properly positioned within the aperture. The method also includes the step of preventing operation of the appliance when the leg is not properly positioned within the aperture.

In accordance with yet another aspect of the present invention, an appliance includes a member projecting from the appliance, an actuator coupled to and movable relative to the member, an interlock switch electrically coupled to control circuitry of the appliance, and an anti-tip bracket having an aperture configured to receive a portion of the member. The actuator is moved relative to the member when the member is positioned within the aperture, and the actuator is adapted to interact with the interlock switch when the member is properly positioned within the aperture.

In accordance with still yet another aspect of the present invention, an appliance includes a leg for supporting the appliance upon a support surface, an interlock switch mechanically coupled to the leg and electrically coupled to control circuitry of the appliance, an anti-tip bracket having an aperture configured to receive a portion of the leg, and means for operating the interlock switch when the leg is properly positioned within the aperture.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
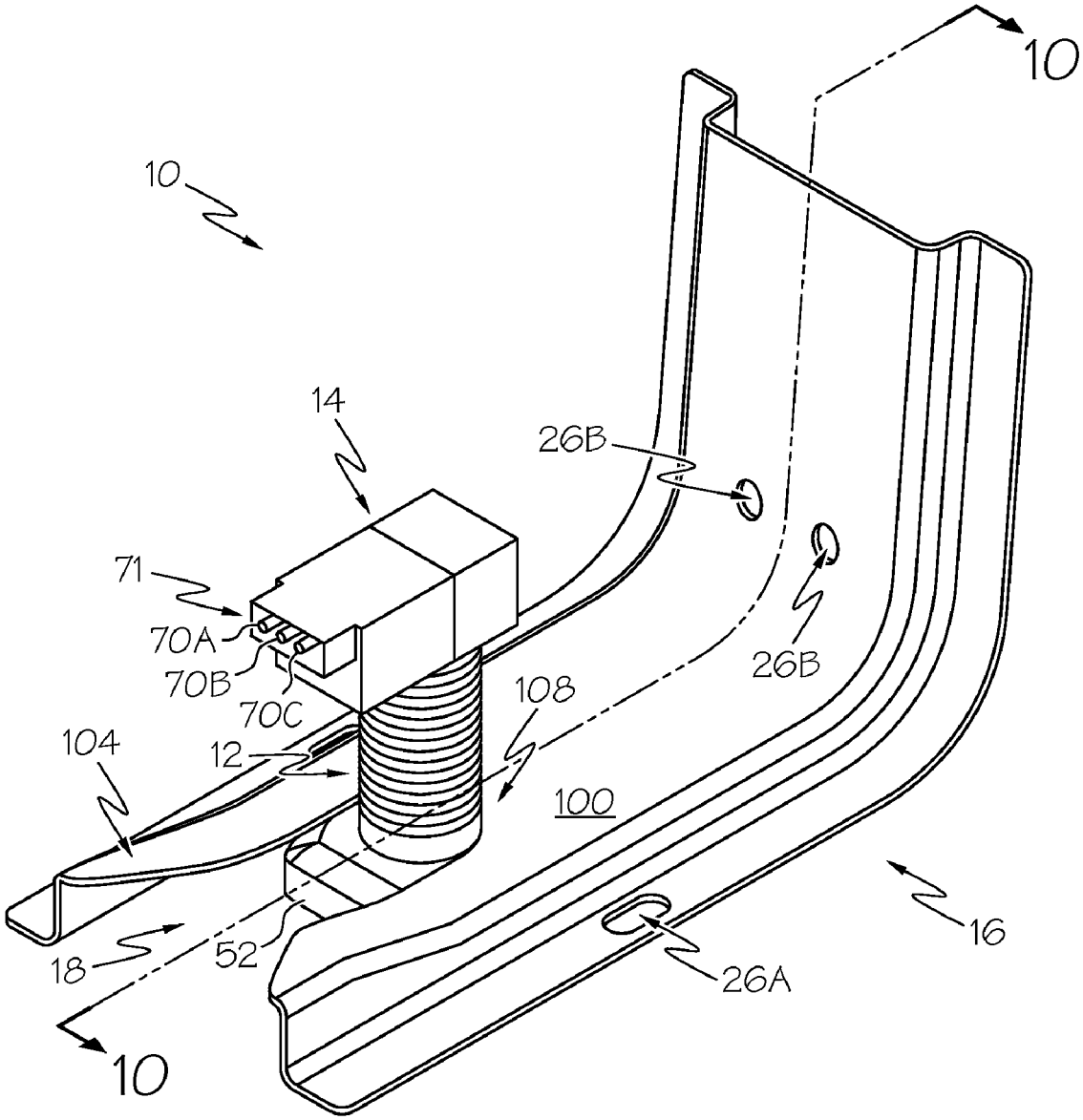
FIG. 1 is a perspective view of an example anti-tip device in accordance with an aspect of the present invention.

An example embodiment of a device that incorporates aspects of the present invention is shown in the drawings. It is to be appreciated that the shown example is not intended to be a limitation on the present invention. For example, one or more aspects of the present invention can be utilized in other embodiments and even other types of devices.

Figure 2:
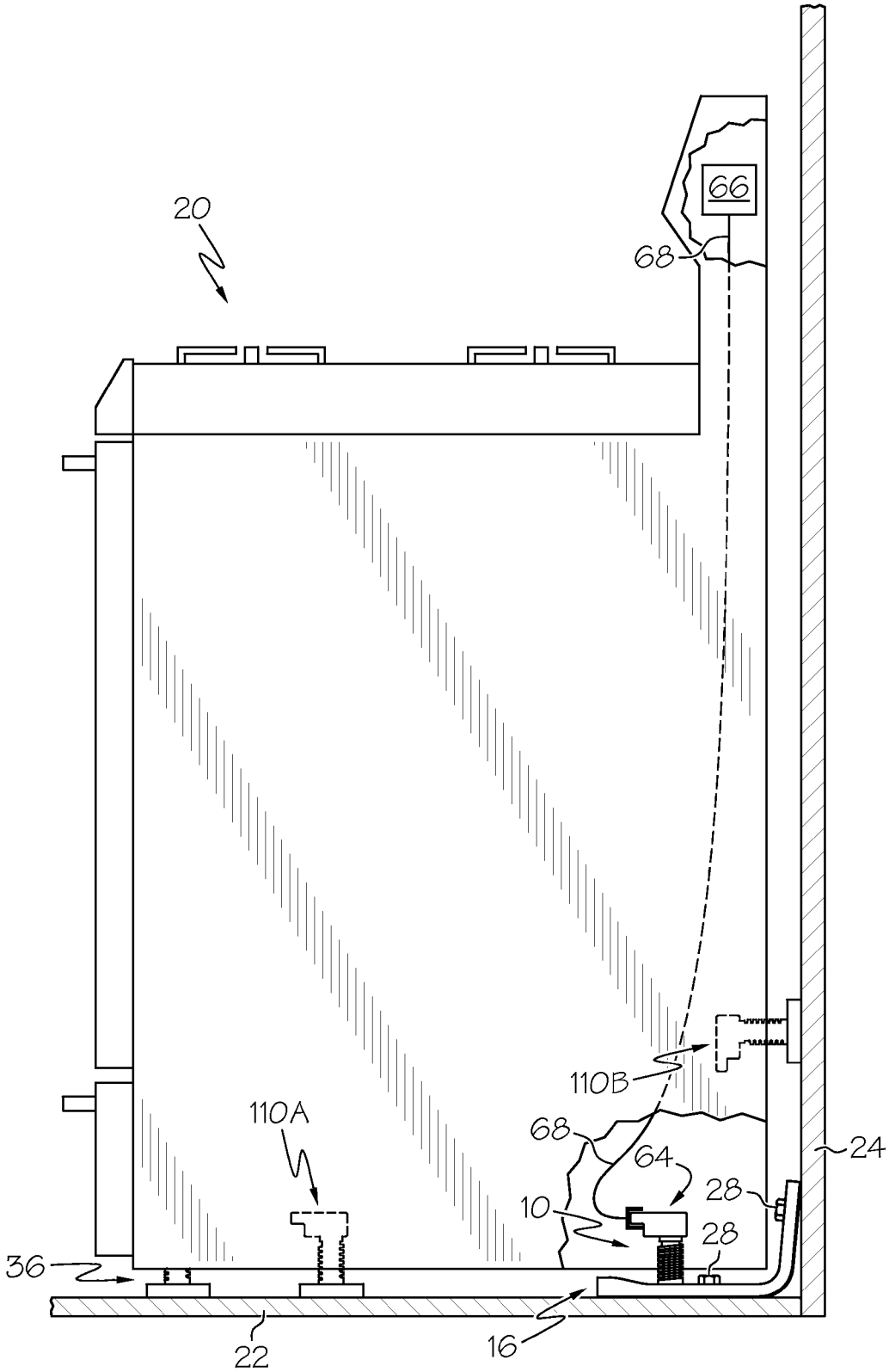
FIG. 2 illustrates a side view of an example range having the anti-tip device of FIG. 1 attached thereto in accordance with an aspect of the invention.

Turning initially to FIGS. 1 and 2, an example anti-tip device 10 is shown in accordance with an aspect of the present invention. As shown, the anti-tip device 10 can generally include a leg 12 for supporting an appliance 20, such as an oven or the like, upon a support surface, such as a floor 22 or wall 24. The anti-tip device 10 can also include an interlock switch assembly 14 and an anti-tip bracket 16, though the anti-tip device 10 can also include more or less elements. Generally, one portion of the leg 12 is coupled to the appliance 20, while another portion of the leg 12 is received within an aperture 18 of the anti-tip bracket 16 to constrain movement of the leg 12 and the appliance 20. The anti-tip bracket 18 can be anchored to the support surface, such as a floor 22 or wall 24 in various manners. In one example, as shown, the anti-tip bracket 16 can include one or more holes 26A, 26B or the like adapted to receive fasteners 28 that are coupled to the support surface. The anti-tip bracket 16 can be fastened or anchored to either or both of the floor 22 or wall 24 (e.g., directly to the wall, to a toe board, or the like) in various manners such that the leg 12 is constrained against movement when it is received within the aperture 18. In other examples, the anti-tip bracket 16 can be removably or non-removably anchored to a support surface by way of adhesives, welding, a snap connection, an interference fit, and/or it can even be formed with the support surface.

The anti-tip bracket 16 is illustrated merely by way of example, and can be modified and adapted accordingly for use with various anti-tip devices 10, various appliances, and/or various support surfaces. As shown, the anti-tip bracket 16 is shown to have a generally "L" shaped geometry. However, it is to be appreciated that the anti-tip bracket 16 can be formed to include various other geometries, such as a generally straight bracket that includes only a floor-engaging portion or only a wall-engaging portion. The anti-tip bracket 16 can also be adapted to engage various floor or wall types, such as concrete, brick, ceramic, linoleum, wood, carpet, plasterboard, metal, plastic, rubber, etc. Additionally, it is contemplated that the support surface can encompass structures other that a wall or floor. In one example, where appliances can be stacked upon each other (e.g., a dryer stacked upon a washing machine), the support surface can include a portion of the subjacent appliance (e.g., the top surface of the washing machine).

Figure 3:
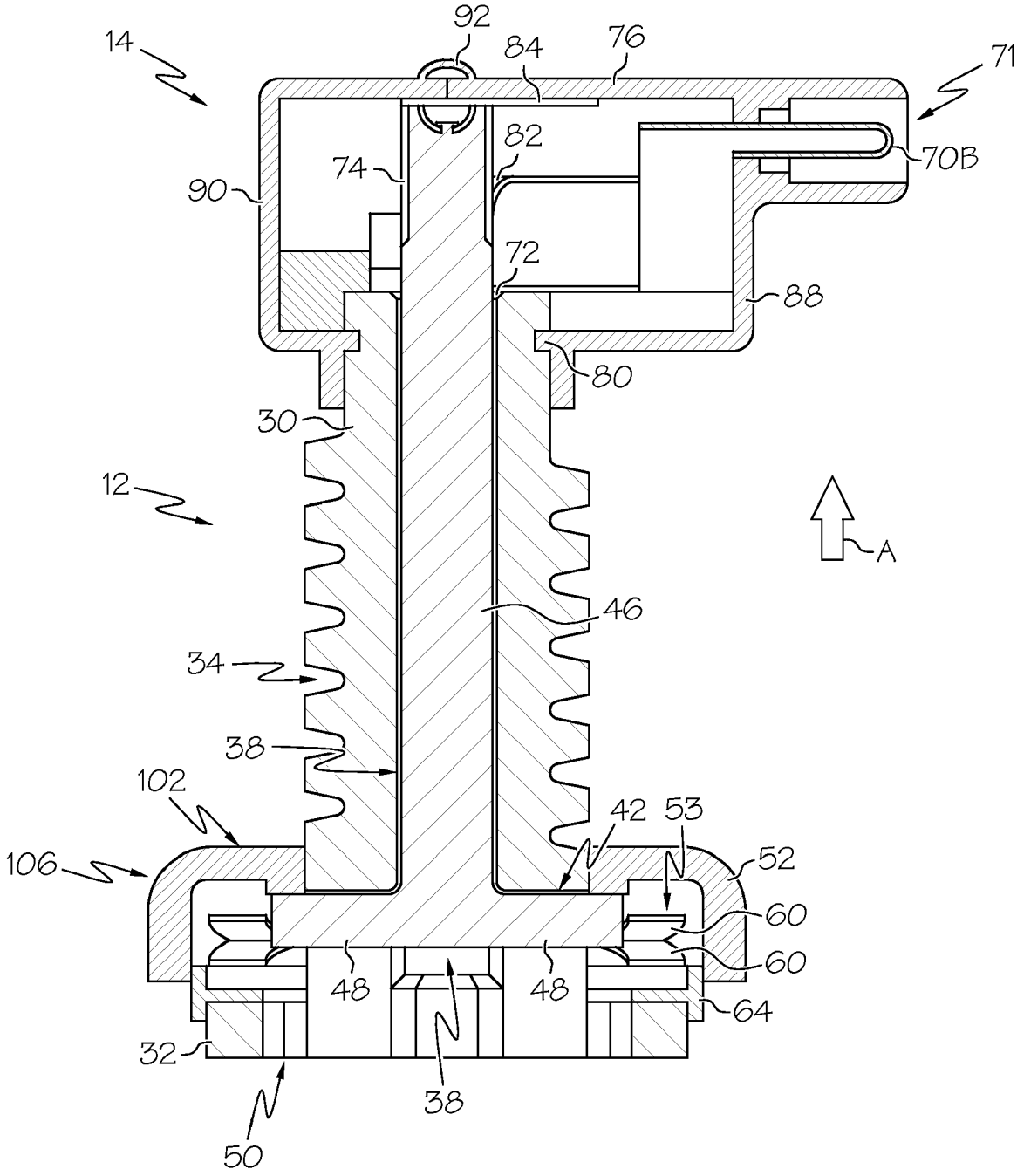
FIG. 3 is a sectional view along line 10-10 of FIG. 1 of the anti-tip device without an anti-tip bracket.

Turning now to the example shown in FIG. 3, a sectional view of the anti-tip device 10 is illustrated along line 10-10 of FIG. 1. For the sake of clarity, the anti-tip bracket 16 is not shown. As previously described, the anti-tip device 10 includes a leg 12 and interlock switch assembly 14, though it can also include various other elements and sub-elements, as will now be described in detail.

Figure 4:
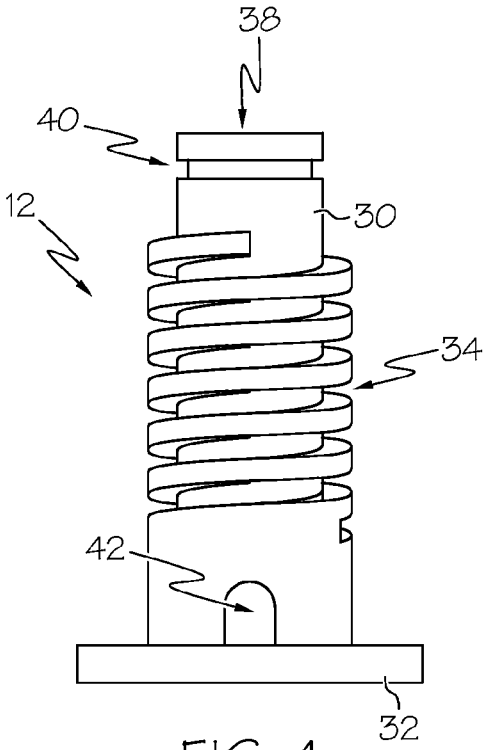
FIG. 4 is a front view of an example leg in accordance with an aspect of the invention.

As shown in FIG. 4, the leg 12 generally includes a main shaft 30 having an enlarged foot 32 at one end that is supported by a support surface (e.g., floor 22, see FIG. 2). Similar to conventional leveling legs for appliances, the main shaft 30 of the leg 12 can include an exterior threaded surface 34 above the foot 32 that engages with corresponding threaded structure on a bottom of an appliance 20 to permit the leg 12 to be vertically adjustable. Such vertical adjustability is desirable to allow the appliance 20 to be leveled at its installation location. As shown in FIG. 2, an appliance 20 typically includes a plurality of conventional leveling legs 36, any or all of which can include a similarly threaded portion to provide individual vertical adjustability. However, any of all of the legs 12, 36 can also include various other methods to provide vertical adjustability. For example, a leveling leg can include a spring-loaded design or the like to provide for an "automatic" leveling of a particular leg. Thus, it can be beneficial to include vertical adjustment structure into the anti-tip device 10 as operation thereof will be then be generally unaffected by the height of the appliance. The leg 12 of the anti-tip device 10 can also include various other features, such as a bore 38 extending therethrough, an annular recess 40 disposed at one end, and/or a slot 42 extending transversely therethrough, as will be discussed more fully herein.

Figure 5:
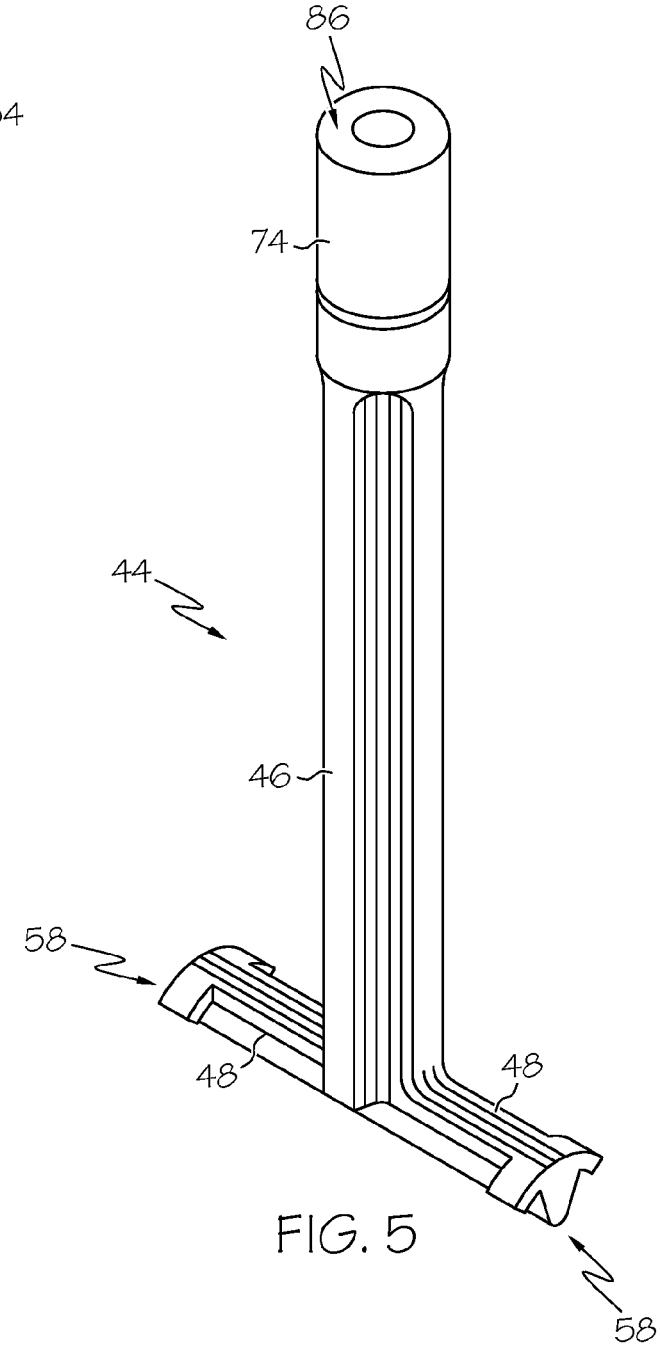
FIG. 5 is an example actuator in accordance with an aspect of the invention.

The anti-tip device 10 can also include various means for operating the interlock switch assembly 14. For example, the anti-tip device 10 can include an actuator 44 coupled to and movable relative to the leg 12. The actuator 44 can include various geometries and can be coupled to the leg 12 directly or indirectly in various manners. For example, as shown in FIGS. 3 and 5, the actuator 44 can include a plunger 46 adapted for telescopic movement within the bore 38 of the main shaft 30. Thus, as shown, the actuator 44 can be adapted to move generally vertically up and down relative to the main shaft 30, though various other motions are also contemplated. The actuator 44 can also include a stop 48 disposed at one end of the plunger 46 for limiting movement of the plunger 46, and/or for facilitating alignment of the plunger 46, relative to the leg 12. The stop 48 can include various structures, such as the shown "T" bar geometry. In one example, the actuator 44 can be assembled with the leg 12 by inserting one end of the plunger 46 upwards through the foot 32 and into the bore 38. The "T" bar stop 48 can extend upwards through a hole or slot 50 in the foot 32 of the leg 12 until the stop 48 abuts the limit of the transverse slot 42 extending through the side of the main shaft 30.

Figure 6:
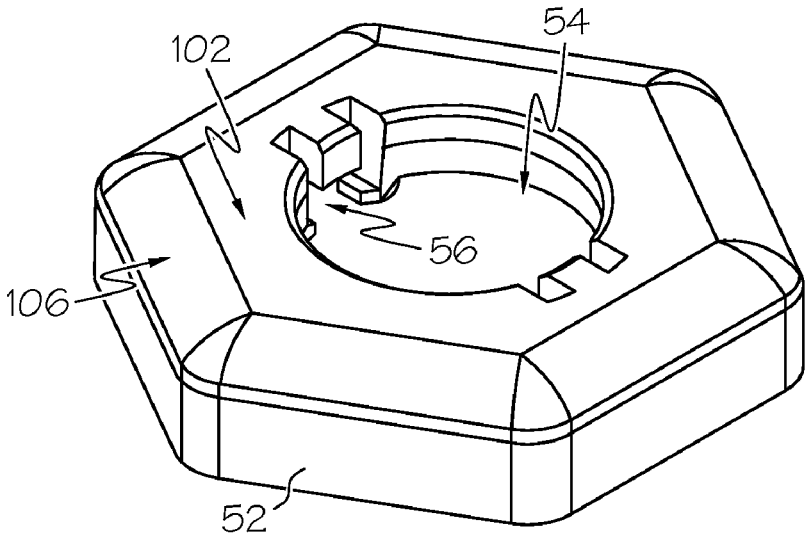
FIG. 6 is an example cap in accordance with an aspect of the invention.

The actuator 44 can remain coupled to the leg 12 in various manners. In one example, as shown in FIGS. 3 and 6, the anti-tip device 10 can include a cap 52 arranged in covering relationship over the stops 48 and foot 30. The cap 52 can include a central hole 54 of sufficient size to receive the main shaft 30, and an inner annular recess 53 of sufficient size to receive the foot 32. During assembly, the cap 52 can slide down the main shaft 30 until it contacts the stops 48, and can then be coupled to either or both of the stops 48 by way of a snap connection or the like. For example, as shown, the cap 52 can include a one-way female snap connection 56 configured to engage a corresponding one-way male snap connection 58 provided on the stops 48. As can be appreciated, the male/female snap connections 56, 58 can alternatively be reversed, and/or can include two-way snap connections (e.g., removable connections). In addition or alternatively, the cap 52 can be coupled to the actuator 44 by way of fasteners, adhesive, welding, etc. Once the cap 52 is coupled to the actuator 44, the plunger 46 is inhibited from being removed from the bore 38 because the foot 32 will abut the annular recess 53.

In addition or alternatively, the actuator 44 can be resiliently biased in a first direction, such as generally upwards as indicated by the arrow A of FIG. 3, though other directions are also contemplated. The actuator 44 can be resiliently biased in various manners, such as by way of a spring or the like. As shown, one or more wave washers 60 (e.g., a Belleville washer or the like) can be disposed within the annular recess 53 and between the cap 52 and the foot 32 of the leg 12. Thus, the wave washers 60 can resiliently bias the cap 52, and thus the actuator 44, along the direction of arrow A. Various other springs can also be used, such as a coil spring, torsion spring, leaf spring, cantilever spring, or the like. In another example, a resilient spring or spring-like structure can be attached to or formed with any of the cap 52, plunger 44, and/or leg 12, etc. In addition or alternatively, a debris shield 62 can be disposed between the foot 32 and the cap 52 to inhibit debris, such as dirt, dust, etc., from entering the anti-tip device 10.

Figure 7:
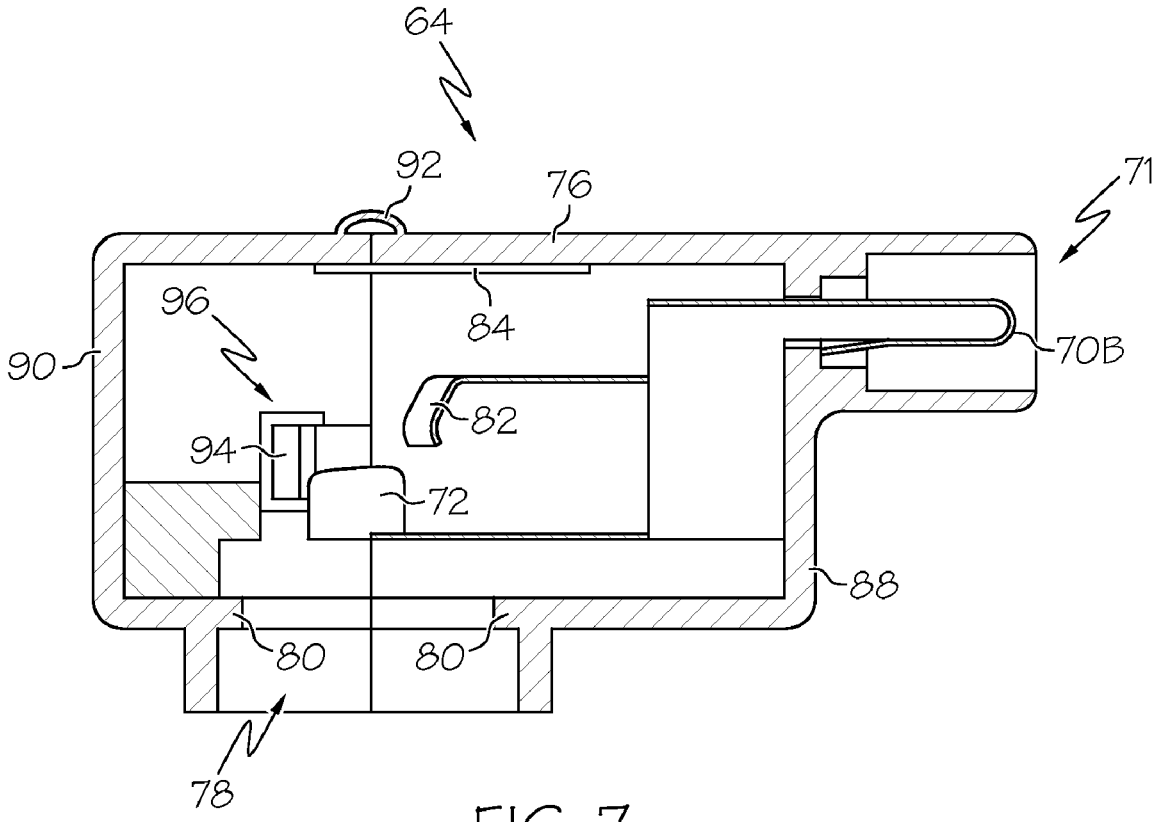
FIG. 7 is a detail, sectional view along line 10-10 of FIG. 1 of an example switch carrier in accordance with an aspect of the invention.

Turning now to the example shown in FIG. 7, the interlock switch assembly 14 (see FIG. 1) of the anti-tip device 10 can include an interlock switch 64 electrically coupled to control circuitry 66 (see FIG. 2) of the appliance 20. The interlock switch 64 can be coupled to the control circuitry 66 in various manners, such as by way of an electrically conductive cable 68 or the like, though it can also be hard-connected directly to the control circuitry 66. The control circuitry 66 can include various elements of the electronics of the appliance 20, such as the power supply (not shown), user operated switches or controls (not shown), analog or digital control boards (not shown), or the like. As shown in FIG. 1, the interlock switch 64 can include three conductors 70A, 70B, 70C arranged in an electrical coupler 71 for connection to the control circuitry 66, though various numbers of conductors (e.g., one or more) can be used. The electrical coupler 71 can include a conventional wire block or the like adapted to receive a corresponding wire plug connected to the cable 68.

The interlock switch 64 can include one or more electrodes adapted to selectively make or break one or more electrical circuits. In one example, the interlock switch 64 can include a first electrode 72 and a second electrode 74. As shown in FIG. 7, the first electrode 72 can be coupled to one of the conductors 70A, 70B, 70C. In addition or alternatively, the first electrode 72 can be coupled to a portion of the leg 12, such as to the main shaft 30. The first electrode 72 can be directly coupled (not shown) to a portion of the leg 12, or can be indirectly coupled to a portion of the leg 12 by way of the switch carrier 76 being coupled to the leg 12. Turning briefly to the FIGS. 3 and 5, the second electrode 74 can be coupled to a portion of the actuator 44. As shown, the second electrode 74 can include a generally tubular sleeve that extends about the outer periphery of the actuator 44 at a distal end, though the electrode 74 can have various geometries and can be disposed variously about the actuator 44. Where the second electrode 74 includes a generally tubular sleeve, the first electrode 72 can include a similarly curved contact surface (e.g., tubular, partially tubular, or the like) so as to increase the electrical contact surface area. The second electrode 74 can be coupled to the actuator 44 in various manners, such as by fasteners, adhesives, welding, snap connection, interference fit, and/or can even be formed therewith. Thus, movement of the actuator 44 will cause corresponding movement of the second electrode 74.

Additionally, the first electrode 72 and the conductors 70A, 70B, 70C can be retained by a switch carrier 76 that is in turn coupled to a portion of the leg 12. As shown, the switch carrier 76 can include the electrical coupler 71, and can also include a hole 78 for receiving a portion of the leg 12. The hole 78 can include a projection 80 therein for making a snap-fit connection with the annular recess 40 of the leg 12. The projection 80 can include one or more projecting members, or can alternatively include an annular ring corresponding to the annular recess 40. As such, the switch carrier 76 can be coupled to the leg 12 so as to move therewith. Thus, the actuator 44 can move relative to the leg 12 and the switch carrier 76.

Accordingly, because the first electrode 72 is coupled to the switch carrier 76, which is in turn coupled to the leg 12, movement of the actuator 44 can cause movement of the second electrode 74 relative to the first electrode 72. Thus, movement of the actuator 44 relative to the leg 12 can cause selective electrical contact between the first and second electrodes 72, 74. For example, as shown in FIG. 3, where the actuator 44 is biased towards the first direction (e.g., along the direction of arrow A), the first electrode 72 can be separated from the second electrode 74 by a distance, such as by 0.030 inches. Thus, in such a configuration, no electrical circuit exists between the first and second electrodes 72, 74. However, if the actuator 44 is moved downwards towards a second direction (e.g., along the direction of arrow B, see FIG. 10), the first and second electrodes 72, 74 can make contact and complete an electrical circuit so as to permit electrical current to flow between the first and second electrodes 72, 74. The completion of the electrical circuit between the first and second electrodes 72, 74 can permit, for example, operation of the appliance 20, as will be discussed more fully here.

Though the above example describes an interlock that operates based upon circuit completion, the reverse (e.g., circuit breakage) could also be used. For example, where the actuator 44 is biased towards the first direction (e.g., along the direction of arrow A), the first electrode 72 can be in contact with the second electrode 74 such that an electrical circuit does exist between the first and second electrodes 72, 74. Subsequently, if the actuator 44 is moved downwards towards a second direction (e.g., along the direction of arrow B, see FIG. 10), the first and second electrodes 72, 74 can then break contact, and break the electrical circuit, so as to inhibit or prevent electrical current to flow between the first and second electrodes 72, 74. The breaking of the electrical circuit between the first and second electrodes 72, 74 can then permit operation of the appliance 20. As can be appreciated by one of skill in the art, the control circuitry 66 of the appliance 20 can be adapted to respond to either of the circuit completion or circuit breakage examples discussed above to selectively permit or prevent operation of the appliance 20.

Keeping with the examples shown in FIGS. 3 and 7, the interlock switch 64 can also include additional electrodes for increased functionality. In one example, the interlock switch 64 can include a third electrode 82 adapted to complete or break a circuit with either or both of the first and second electrodes 72, 74. As shown in FIG. 3, the third electrode 82 can be spaced a distance from the first electrode 72, and an electrical circuit can be completed between the first and third electrodes 72, 82 by way of the second electrode 74 acting as an intermediary. Thus, as shown, movement of the actuator 44 relative to the leg 12 (e.g., along the direction of arrow B, see FIG. 10) can cause the second electrode 74 to be in contact with both of the first and third electrodes 72, 82 to thereby establish a circuit along all three electrodes 72, 74, 82. As can be readily appreciated, the arrangement of the three electrodes 72, 74, 82 can also be modified so as to permit movement of the actuator 44 to cause the second electrode 74 to break an electrical circuit between the first and third 72, 82 electrodes.

In addition or alternatively, the interlock switch 64 can also include an auxiliary electrode 84 adapted to complete or break a circuit with any or all of the first and second electrodes 72, 74, or even the third electrode 82, if present. As shown, the auxiliary electrode 84 can be located towards an upper portion of the switch carrier 76, though it can also be disposed at various other locations. In one example, movement of the actuator 44 relative to the leg 12 can cause selective electrical contact between the second and auxiliary electrodes 74, 84 to thereby indicate the presence of the interlock switch 64. Thus, as shown, a top portion 86 (see FIG. 5) of the second electrode 74 can selectively be in contact with the auxiliary electrode 84 to complete or break an electrical circuit. In addition or alternatively, the second electrode 74 can act as an intermediary between the auxiliary electrode 84 and the third electrode 82 so as to permit a circuit to be completed or broken therebetween. As can be appreciated, the top portion 86 of the second electrode 74 can be formed with the second electrode 74, though it can also include a separate element (e.g., a separate electrode).

As stated previously, the auxiliary electrode 84 can be configured to indicate the presence of the interlock switch 64 to facilitate servicing of the appliance 20. As can be appreciated, it can be beneficial to enable a user to diagnose a problem without requiring the user to make a service call. For example, as shown in FIG. 3, when the interlock switch 64 is present and attached to the leg 12, an electrical circuit can be completed between the second and auxiliary electrodes 74, 84, and even further between the third and auxiliary electrodes 82, 84. Thus, such an electrical circuit can be sensed by the control circuitry 66 of the appliance 20 to indicate the presence of the interlock switch 64. An audio (speech, sounds, etc.), visual (lights, text, symbols, or the like, not shown), or other indication can be announced or displayed by the appliance 20 to a user. Thus, where an appliance 20 is not operational, a user can quickly determine whether the non-operational status is due to a lack of the interlock switch 64 being present and/or being connected to the control circuitry 66, or whether the appliance 20 has a separate problem. Of course, the auxiliary circuit 84 can also be configured to provide a broken circuit that can also be sensed to indicate the presence of the interlock switch 64, as described variously above.

Further, the control circuitry 66 can be configured to understand the various completed and broken circuits that result from movement of the actuator 44. For example, while a completed circuit may initially exist between the second and auxiliary electrodes 74, 84 indicate the presence of the interlock switch 64, downward movement of the actuator 44 (e.g., along the direction of arrow B) will subsequently break that circuit when the leg 12 is received by the anti-tip bracket 16. Of course, such movement of the actuator 44 will then complete a circuit between the first and second electrodes 72, 74 to indicate that the leg 12 is properly positioned within the anti-tip bracket 16. Thus, the control circuitry 66 can be configured to understand the various completed and broken circuits to permit operation of the appliance 20.

As can be appreciated by one of skill in the art, the various electrodes 72, 74, 82, 84 can be coupled to the various conductors 70A, 70B, 70C in various manners. The cable 68 can include separate conductive wires for each of the conductors to provide independent electrical paths to the control circuitry 66. Also, as shown in greater detail in FIG. 7, any or all of the electrodes 72, 82, 84 in the interlock switch 64 can include an arcuate portion, generally corresponding to the cylindrical geometry of the actuator 44, to facilitate electrical contact with the second electrode 74 over the range of motion of the actuator 44. Further, the various electrodes 72, 82, 84 in the interlock switch 64 can be configured to permit or inhibit crossing of the various electrical circuits. For example, the electrodes 72, 82, 84 can be arranged in a "break-before-make" situation such that, with respect to the second electrode 74, the connection to the auxiliary electrode 84 is always broken before the connection to the first electrode 72 is made. Alternatively, a "make-before-break" connection could also be used. As can be appreciated, connection to the third electrode 82 can be generally constant to provide a common or ground connection for the various electrical circuits. Of course, the geometry, orientation, location, and/or size of any or all of the electrodes 72, 74, 82, 84 can be modified, and/or various other electrodes can be included to provide additional functionality. For example, the geometry, orientation, location, and/or size of any or all of the electrodes 72, 74, 82, 84 can be adapted to provide a predetermined vertical adjustability to accommodate various floor types (e.g., vinyl, wood, tile, ceramic, brick, concrete, metal, carpet, engineered floors, etc.) having various compression properties during installation or even over time (e.g., sagging over time).

Figure 8:
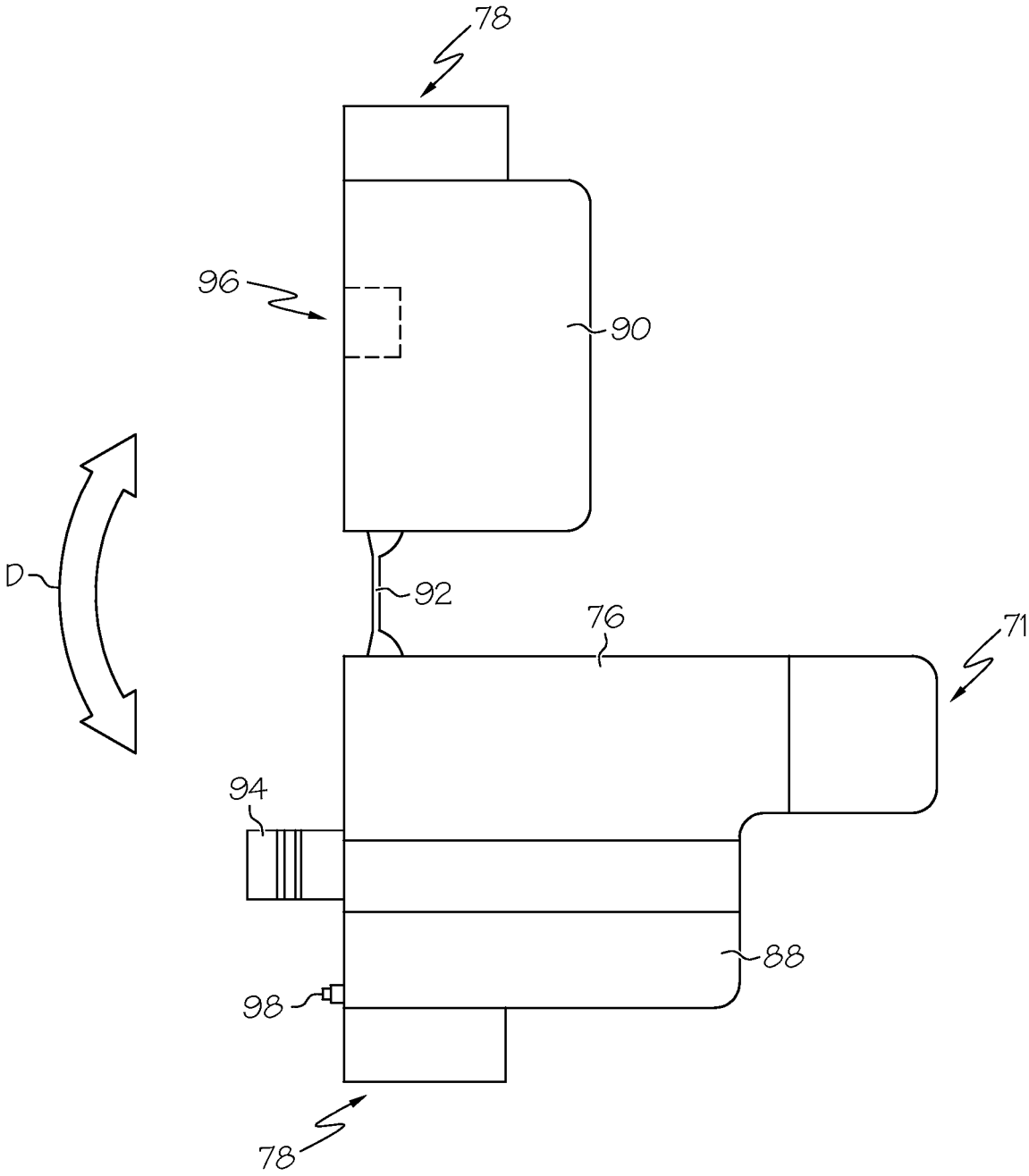
FIG. 8 is a side view of the switch carrier of FIG. 6 illustrating an example anti-tamper connection.

Turning briefly to the example shown in FIG. 8, the various electrodes 72, 82, 84 can be housed in the switch carrier 76 that can be rotatably coupled to a portion of the leg 12. Providing the switch carrier 76 separate from the leg 12 can facilitate assembly of the anti-tip device 10 with the appliance 20, such as by permitting the leg 12 to be coupled to the appliance by way of the external threads 34 before the switch carrier 76 is attached thereto. As stated previously, the switch carrier 76 can be coupled to an upper portion of the leg 12 via the projection(s) 80 being received within an annular recess 40 of the leg 12. As shown in FIG. 3, the projection 80 and annular recess 40 can each be adapted to provide a rotatable coupling between the switch carrier 76 and the leg 12 so as to permit relative rotation therebetween without interrupting the selective electrical contact between any of the electrodes 72, 74, 82, 84. Thus, the leg 12 can be rotated relative to the switch carrier 76 to permit the leg 12 to provide leveling of the appliance 20 via the threaded connection 34 thereto, as is conventional. In addition or alternatively, the switch carrier 76 can be rotated relative to the leg 12 to facilitate assembly within the appliance 20 and/or connection to the cable 68. For example, the relative rotation can avoid the twisting of wires in the cable 68. Additionally, as shown in FIG. 5, the second electrode 74 can have a generally cylindrical geometry so as to maintain electrical contact with any of the electrodes 72, 82, 84 despite relative rotation between the switch carrier 76 and the leg 12.

In addition or alternatively, in an effort to inhibit a user from altering, tampering, and/or bypassing the anti-tip device 10, a portion of the switch carrier 76 can also include an anti-tamper connection adapted for a one-time installation. In one example, the switch carrier 76 can include at least two separable portions 88, 90 to provide access to the interior, such as for assembly of the various electrodes 72, 82, 84 or the like. The two separable portions 88, 90 can be entirely separate, or can be attached to each other by way of a hinge or the like, such as by way of a living hinge 92, though various other hinges are also contemplated. In addition, the two separable portions 88, 90 can be coupled together in various manners, such as by way of a snap connection. For example, the first portion 88 can include a male snap element 94 adapted to engage a corresponding female snap element 96 on the second portion 90, though the snap elements 94, 96 can be reversed. Thus, the second portion 90 can be rotated along the direction of arrow D towards the first portion 88 until the male snap element 94 engages and is retained by the female snap element 96. As shown, both of the snap elements 94, 96 can be arranged so as to be disposed completely within the interior of the switch carrier 76 such that once the two separable portions 88, 90 are coupled together, the snap elements 94, 96 are inaccessible from the exterior of the switch carrier 76. The switch carrier 76 can also include one or more locator pins 98 to facilitate alignment of the first portion 88 to the second portion 90 during coupling.

In addition or alternatively, the switch carrier 76 can include features adapted to indicate user tampering, if it occurs. For example, the snap elements 94, 96 can be formed of a relatively soft or brittle material configured for one-time installation. Thus, even if the snap elements 94, 96 were subsequently forced apart, such separation would severely damage or even break either or both of the snap elements 94, 96. In addition or alternatively, such damage to the snap elements 94, 96 could inhibit or prevent the interlock switch 64 from operating, which could thereby inhibit or prevent the appliance from operating 20. In yet another example, any or all of the two separable portions 88, 90 and/or the snap elements 94, 96 can be formed of relatively soft or brittle materials that would exhibit signs of user tampering, such as scratches, color or surface texture changes, broken pieces, tool marks, etc. In yet another example, it is to be appreciated that the switch carrier 76 can also be formed as a single element to inhibit tampering. For example, the switch carrier 76 can be molded as a unitary body having the various electrodes 72, 82, 84 or the like integrally molded therein.

Figure 9:
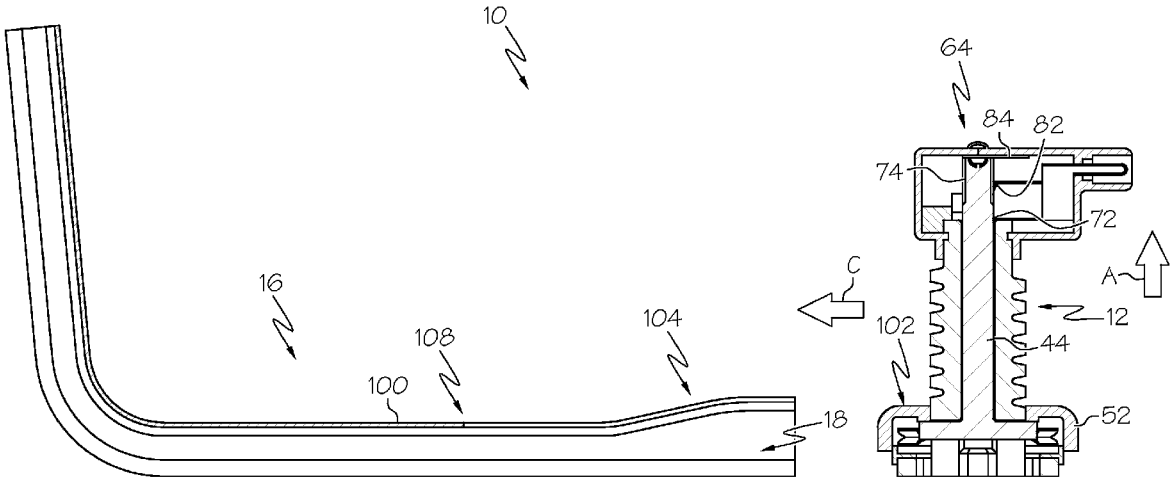
FIG. 9 is a sectional view along line 10-10 of FIG. 1 illustrating the actuator being biased towards a first direction in accordance with an aspect of the invention.
Figure 10:
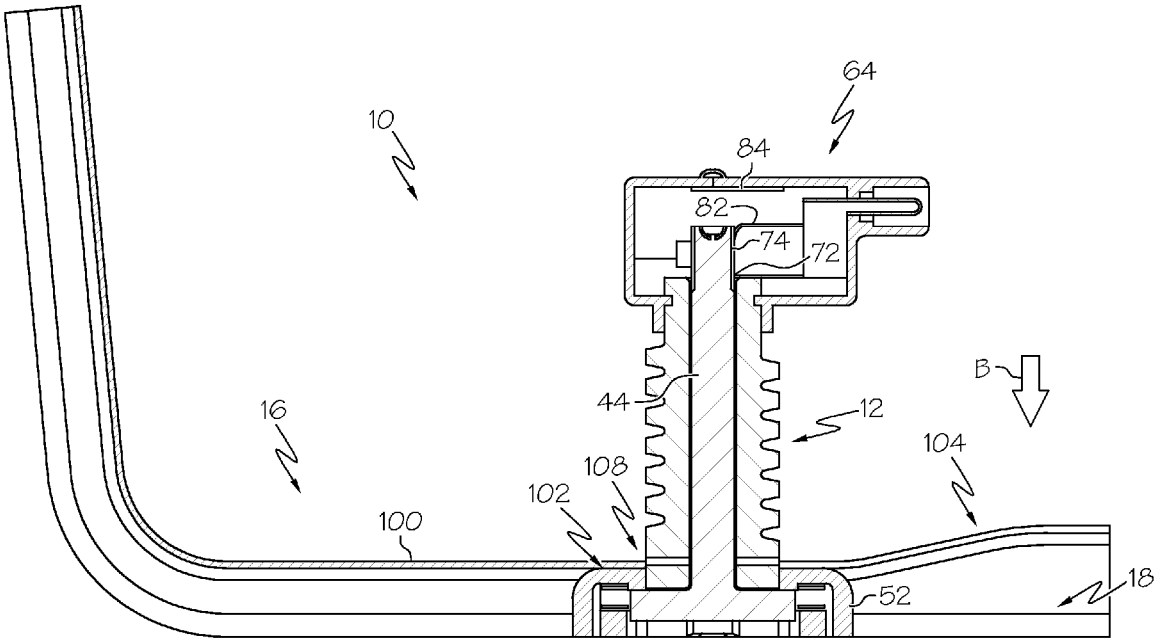
FIG. 10 is similar to FIG. 9, but shows the actuator being biased towards a second direction.

Turning now to the examples shown in FIGS. 9 and 10, an example operation of the anti-tip device 10 will now be described. Turning initially to FIG. 9, the leg 12 and interlock switch 64 are separated a distance from the anti-tip bracket 16, and are positioned to enter the aperture 18. Of course, the interlock switch 64 can alternatively be coupled to the leg 12 at a later time, if desired. As shown, the actuator 44 is biased towards a first direction along the direction of arrow A, and the second electrode 74 is in electrical contact with the third and auxiliary electrodes 82, 84 to complete a circuit therebetween. To operate the interlock switch 64, the leg 12 and interlock switch 64 are moved, towards the direction of arrow C, into the aperture 18 of the anti-tip bracket 16.

As shown, the aperture 18 of the anti-tip bracket 16 is at least partially bounded by a wall 100, which can be an upper wall. The wall 100 is adapted to engage a top portion 102 the cap 52, forcing it generally downwards. As can be appreciated, movement of the cap 52 will cause corresponding movement of the actuator 44 relative to the leg 12, as previously described herein. When the actuator 44 is biased towards the first direction, the vertical distance between the support surface 22 (e.g., floor, wall, etc.) and the wall 100 can be generally less than the distance between the support surface 22 and the top portion 102 of the cap 52. Thus, when the leg 12 is properly positioned within the aperture 18 of the anti-tip bracket 16, the wall 100 of the bracket 102 will automatically engage the cap 52 to move it and the actuator 44 towards a second direction along the direction of arrow B (e.g., generally downwards). In doing so, the second electrode 74 will break electrical contact with the auxiliary electrode 84, and will instead make electrical contact with the first and third electrodes 72, 82 to complete a circuit therebetween. Once the electrical circuit is completed, the control circuitry 66 can permit the appliance 20 to be operated.

Because the vertical distance between the support surface 22 (e.g., floor, wall, etc.) and the wall 100 is generally less than the distance between the support surface 22 and the top portion 102 of the cap 52, the aperture 18 of the anti-tip bracket 16 can include a ramped portion 104 to facilitate ingress of the leg 12 within the aperture 18. Thus, the vertical distance between the support surface 22 and the end of the ramped portion 104 can be greater than the distance between the support surface 22 and the top portion 102 of the cap 52, and can then taper down towards the vertical distance of the wall 100. Additionally, some or all of the edges 106 of the cap 52 can include a rounded or tapered geometry for cooperation with the ramped portion 104. Finally, the terminal end 108 of the aperture 18 can have a generally rounded geometry similar to that of the leg 12 to support the leg 12 and/or have a location that indicates a proper insertion distance or positioning of the leg 12 within the aperture 18.

Of course, movement of the actuator 44 towards the second direction will compress the wave washers 60, and if the leg 12 is subsequently removed from the anti-tip bracket 16, the wave washers 60 will move the actuator 44 back towards the first direction. In such a case, the electrical contact between the first and third electrodes 72, 82 will be broken, and the control circuitry 66 will inhibit or prevent the appliance 20 from operating. It is to be appreciated that although the foregoing example described particular completed and broken circuits, any of the various other circuit combinations (e.g., circuit breakage) described herein can also be used in various combinations. Additionally, although the second direction (e.g., downwards) is shown generally opposite of the first direction (e.g., upwards), the directions can also have various other relationships (e.g., parallel, angled, perpendicular, curved, multiple combinations thereof, etc.).

Although the foregoing examples have been described with reference to a load-bearing leveling leg for the appliance, it is to be appreciated that the anti-tip device 10 can include other variations. Turning back to FIG. 2, for example, an anti-tip device for the appliance 20 can include one or more members 110A, 110B projecting from the appliance 20. As shown, one example member 110A is shown projecting from the bottom of the appliance 20, while another example member 110B is shown projecting from the rear of the appliance 20, though other locations are also contemplated. Either or both of the members 110A, 110B can be used, and either or both can be load-bearing or generally non-load-bearing. For example, although the member 110A is shown projecting from the bottom of the appliance 20, the weight of the appliance 20 can be partially or completely be supported by one or more conventional leveling legs 36. Thus, the member 110A can include similar structure to the anti-tip device 10 as described herein (e.g., leg 12, anti-tip bracket 16, actuator 44, interlock switch 64, etc.) and can operate in generally the same manner, though the structure can be generally non-load-bearing so as to support little or no weight of the appliance 20. However, the member 110A can still be coupled to the appliance 20 and retained by an anti-tip bracket 16 so as to inhibit or prevent the appliance 20 from tipping. In another alternative, the member 110B can project from the rear of the appliance 20 and can similarly inhibit or prevent tipping, while providing little or no load-bearing support for the appliance 20. Of course, the member 110B can be located at various locations along the rear of the appliance 20, such as towards the bottom, as shown, or even towards the top near the control circuitry 66. Usage of such members 110A, 110B can be useful, for example, when it is difficult or undesirable to attach an anti-tip bracket 16 to a particular floor or wall surface, where appliances are stacked, etc. Of course, either or both of the members 110A, 110B can include more or less elements than the aforedescribed anti-tip device 10.

In addition or alternatively, the present invention can also include a method for preventing use of an appliance 20 due to improper installation of the appliance 20. For example, the method can include the steps of providing the leg 12 for supporting the appliance 20 upon a support surface 22, 24, and providing an interlock switch 64 electrically coupled to the control circuitry 66 of the appliance 12. The method can also include the steps of providing an anti-tip bracket 16 with the aperture 18 configured to receive a portion of the leg 12 to prevent tipping of the appliance 20, and preventing operation of the appliance 20 when the leg 12 is not properly positioned within the aperture 18. In other examples, the method can include the step of fastening the anti-tip bracket 16 to the support surface 22 on which the appliance 20 operates, such as the floor. In another example, the method can include the steps of providing the interlock switch with the first and second electrodes 72, 74, and moving the actuator 44 relative to the main shaft 30 to cause selective electrical contact between the first and second electrodes 72, 74. In still other examples, the method can include the step of moving of the actuator 44 relative to the main shaft 30 until the first and second electrodes 72, 74 complete an electrical circuit to thereby permit operation of the appliance 20, and/or resiliently biasing the actuator 44 towards a first direction and subsequently moving the actuator 44 in second direction generally opposite to the first direction to cause selective electrical contact between the first and second electrodes 72, 74. In addition or alternatively, the method can also include the step of providing the switch carrier 76 with an electrical coupler 71 or the like to permit the interlock switch 64 to be electrically coupled to control circuitry 66 of the appliance 20, and/or providing the switch carrier 64 with an anti-tamper connection designed for a one-time installation. Of course, the method can include any or all of the steps and/or structure previously described herein, though can also include more or less steps and/or structure.

It is also to be appreciated that the anti-tip device of the subject invention can be used in settings other than in a range. For example, the racks of the subject invention could be used in a refrigerator, freezer unit, icemaker, dishwasher, washing machine, dryer, or the like. Even further still, the anti-tip device can be utilized in various other applications, such as furniture, power tools, shelving, computer equipment, exercise equipment, equipment supports, commercial or industrial equipment, and/or various other applications that may be subject to undesirable tipping.

Additionally, the size and/or geometry of the anti-tip device of the subject invention can also depend upon the intended use of the rack. For example, the size and/or geometry can be varied depending upon the type of appliance and/or the type of support surface it is intended to be used with. In the example embodiments, the anti-tip device is sized to replace a leveling leg of a conventional oven. However, the various elements of the anti-tip can be made larger to fit commercial appliances (e.g., commercial ovens, refrigerators, freezer units, icemakers, dishwashers, washers, dryers, or the like), or sized to fit various other applications in which the anti-tip device is to be used. In such a case, the size and/or geometry of the anti-tip device can be adapted accordingly. Further, it is to be appreciated that the various elements of the anti-tip device can be made of suitable materials, such as metal, plastic, hard rubber, and the like. Further still, the various elements need not be constructed from the same materials.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An appliance, including:

a leg for supporting the appliance upon a support surface;

an actuator coupled to and movable relative to the leg;

an interlock switch positioned upon and secured to the leg and electrically coupled to control circuitry of the appliance; and an anti-tip bracket having an aperture configured to receive a portion of the leg, wherein the actuator is moved relative to the leg when the leg is positioned within the aperture, and wherein the actuator is adapted to interact with the interlock switch when the leg is properly positioned within the aperture.

2. The appliance of claim 1, wherein operation of the appliance is prevented when the leg is not properly positioned within the aperture.

3. The appliance of claim 1, wherein the leg includes a bore and the actuator includes a plunger adapted for telescopic movement within the bore.

4. The appliance of claim 1, wherein the interlock switch includes a first electrode and a second electrode, the second electrode being coupled to a portion of the actuator, movement of the actuator relative to the leg causing selective electrical contact between the first and second electrodes.

5. An appliance, including:

a leg for supporting the appliance upon a support surface;

an actuator coupled to and movable relative to the leg;

an interlock switch secured to the leg and electrically coupled to control circuitry of the appliance; and an anti-tip bracket having an aperture configured to receive a portion of the leg, wherein the actuator is moved relative to the leg when the leg is positioned within the aperture, and wherein the actuator is adapted to interact with the interlock switch when the leg is properly positioned within the aperture, wherein the interlock switch includes a first electrode and a second electrode, the second electrode being coupled to a portion of the actuator, movement of the actuator relative to the leg causing selective electrical contact between the first and second electrodes, and wherein the first electrode is coupled to a portion of the leg.

6. The appliance of claim 4, wherein movement of the actuator relative to the leg causes the first and second electrodes to complete an electrical circuit to thereby permit operation of the appliance.

7. The appliance of claim 6, wherein the interlock switch further includes a third electrode, movement of the actuator relative to the leg causing the second electrode to complete an electrical circuit between the first and third electrodes to thereby permit operation of the appliance.

8. The appliance of claim 4, wherein the interlock switch further includes an auxiliary electrode, movement of the actuator relative to the leg causing selective electrical contact between the second and auxiliary electrodes to thereby indicate the presence of the interlock switch.

9. The appliance of claim 4, wherein movement of the actuator relative to the leg causes the first and second electrodes to break an electrical circuit to thereby permit operation of the appliance.

10. An appliance, including:

a leg for supporting the appliance upon a support surface;

an actuator coupled to and movable relative to the leg;

an interlock switch secured to the leg and electrically coupled to control circuitry of the appliance; and an anti-tip bracket having an aperture configured to receive a portion of the leg, wherein the actuator is moved relative to the leg when the leg is positioned within the aperture, and wherein the actuator is adapted to interact with the interlock switch when the leg is properly positioned within the aperture, wherein the interlock switch includes a first electrode and a second electrode, the second electrode being coupled to a portion of the actuator, movement of the actuator relative to the leg causing selective electrical contact between the first and second electrodes, and further including a switch carrier coupled to a portion of the leg and including an electrical coupler to permit the interlock switch to be electrically coupled to control circuitry of the appliance, the first electrode being coupled to a portion of the switch carrier.

11. The appliance of claim 10, wherein a portion of the switch carrier includes an anti-tamper snap connection adapted for a one-time installation.

12. The appliance of claim 10, wherein the switch carrier is rotatably coupled to a portion of the leg such that the leg can rotate relative to the switch carrier without interrupting the selective electrical contact between the first and second electrodes.

13. The appliance of claim 1, wherein a cap is coupled to a portion of the actuator and wherein the aperture of the anti-tip bracket is at least partially bounded by a wall, the wall being adapted to engage the cap to cause movement of the actuator relative to the leg when the leg is properly positioned within the aperture.

14. The appliance of claim 13, wherein the actuator is resiliently biased in a first direction, engagement of the cap with the wall causing the actuator to move in second direction generally opposite to the first direction.

15. The appliance of claim 1, wherein the aperture of anti-tip bracket includes an open end for receiving a portion of the leg, the open end having a ramped portion to facilitate ingress of the leg within the aperture.

16. An appliance, including:

a member projecting from the appliance;

an actuator coupled to and movable relative to the member;

an interlock switch secured to the member and electrically coupled to control circuitry of the appliance; and an anti-tip bracket having an aperture configured to receive a portion of the member, wherein the actuator is moved relative to the member when the member is positioned within the aperture, and wherein the actuator is adapted to interact with the interlock switch when the member is properly positioned within the aperture, wherein the member includes a bore and the actuated includes a plunger adapted for telescopic movement within the bore.

17. The appliance of claim 16, wherein the member includes a leg for supporting the appliance upon a support surface.

18. The appliance of claim 16, wherein operation of the appliance is prevented when the member is not properly positioned within the aperture.

19. The appliance of claim 16, wherein the interlock switch includes a first electrode and a second electrode, the second electrode being coupled to a portion of the actuator, movement of the actuator relative to the main shaft causing selective electrical contact between the first and second electrodes.

20. The appliance of claim 19, wherein movement of the actuator relative to the member causes the first and second electrodes to complete an electrical circuit to thereby permit operation of the appliance.

21. The appliance of claim 20, wherein the interlock switch further includes a third electrode, movement of the actuator relative to the leg causing the second electrode to complete an electrical circuit between the first and third electrodes to thereby permit operation of the appliance.

22. The appliance of claim 19, wherein the interlock switch further includes an auxiliary electrode, movement of the actuator relative to the leg causing selective electrical contact between the second and auxiliary electrodes to thereby indicate the presence of the interlock switch.

23. The appliance of claim 19, further including a switch carrier coupled to a portion of the member and including an electrical coupler to permit the interlock switch to be electrically coupled to control circuitry of the appliance, the first electrode being coupled to a portion of the switch carrier.

24. The appliance of claim 16, wherein the member further includes a cap coupled to a portion of the actuator and wherein the aperture of the anti-tip bracket is at least partially bounded by a wall, the wall being adapted to engage the cap to cause movement of the actuator relative to the member when the member is properly positioned within the aperture.

25. An appliance, including:

a leg for supporting the appliance upon a support surface;

an interlock switch secured to the leg and electrically coupled to control circuitry of the appliance;

an anti-tip bracket having an aperture configured to receive a portion of the leg; and means for operating the interlock switch when the leg is properly positioned within the aperture, wherein the means for operating the interlock switch further includes a cap and wherein the aperture of the anti-tip bracket is at least partially bounded by a wall, the wall being adapted to engage the cap to cause operation of the interlock switch when the member is properly positioned within the aperture.

26. The appliance of claim 25, wherein operation of the appliance is prevented when the leg is not properly positioned within the aperture.

27. The appliance of claim 25, wherein the means for operating the interlock switch includes an actuator movable relative to the leg.

28. The appliance of claim 27, wherein the interlock switch includes a first electrode and a second electrode, the second electrode being coupled to a portion of the actuator, movement of the actuator relative to the main shaft causing selective electrical contact between the first and second electrodes.

29. The appliance of claim 28, wherein movement of the actuator relative to the member causes operation of the interlock switch to permit operation of the appliance when the first and second electrodes complete an electrical circuit.

30. The appliance of claim 28, further including a switch carrier coupled to a portion of the member and including an electrical coupler to permit the interlock switch to be electrically coupled to control circuitry of the appliance, the first electrode being coupled to a portion of the switch carrier.

* * * * *